US005895216A

United States Patent [19]

Heuss

[11] Patent Number: 5,895,216

[45] Date of Patent: Apr. 20, 1999

[54] CARRYING DEVICE FOR SUPPORTING A CHARGE IN A RE-HEATING FURNACE

[75] Inventor: Helmut Heuss, Ratingen, Germany

[73] Assignee: LOI Thermprocess GmbH, Germany

[21] Appl. No.: 08/926,807

[22] Filed: Sep. 9, 1997

[30] Foreign Application Priority Data

Sep. 28, 1996 [DE] Germany ..... 196 40 173

[51] Int. Cl.[6] ..... F27D 3/02

[52] U.S. Cl. ..... 432/234; 432/235

[58] Field of Search ..... 432/234, 235, 432/241, 253, 258

[56] References Cited

U.S. PATENT DOCUMENTS

| | | | |
|---|---|---|---|
| 4,689,009 | 8/1987 | Heuss | 432/234 |
| 5,136,610 | 8/1992 | Heuss | 432/234 |
| 5,284,440 | 2/1994 | Campbell, Jr. et al. | 432/234 |
| 5,288,228 | 2/1994 | Fujita et al. | 432/234 |
| 5,405,264 | 4/1995 | Heuss | 432/234 |

*Primary Examiner*—Teresa Walberg
*Assistant Examiner*—Gregory A. Wilson
*Attorney, Agent, or Firm*—Blakely Sokoloff Taylor & Zafman

[57] ABSTRACT

A carrying device for supporting a charge in a reheating furnace is disclosed. The carrying device has several tubular supports through which coolant flows, said tubular supports being provided with high-temperature-resistant riders. Each rider has a top section and a bottom section. The bottom section is limited by sides which are inclined towards each other in the direction of the head section and form protruding steps with the latter. Plate-shaped heat insulation elements supported by support cams are inserted in the resulting recesses. The plate-shaped elements, which are not subject to wear from the movement of the riders, cover the sides of the bottom section of the rider and provide heat insulation for the bottom section. Thus the bottom section is protected against wear-promoting overheating and heat is also prevented from passing from the charge to the bottom section. On the contrary, the plate-shaped elements radiate heat to the charge, thus avoiding the formation of cold charge areas.

22 Claims, 5 Drawing Sheets

CARRYING DEVICE FOR SUPPORTING A CHARGE IN A RE-HEATING FURNACE

BACKGROUND OF THE INVENTION

1.) Field of the Invention

The present invention relates to a carrying device for supporting a charge in a reheating furnace.

In particular, the invention relates to a carrying device for supporting a charge of slabs, billets, ingots and the like in a reheating furnace, with at least one tubular support through which coolant flows, at least one high-temperature-resistant rider which has a top section and a bottom sections the bottom section of the rider being mounted on the tubular support and the top section forming at least one support surface to support the charge, and heat insulation means arranged on the bottom section of the rider.

Such carrying devices are preferably used in pusher-type and walking-beam furnaces which are upstream of a rolling mill. A major problem is to heat the charge as evenly as possible as only an even temperature of the charge guarantees uniform shaping in the downstream rolling mill. The quality of the final product is largely determined by the uniformity of shaping.

The critical points for the heating of the charge are the points where the charge is supported on the riders of the carrying device. As the bottom sections of the riders are mounted on the cooled tubular supports, heat automatically dissipates from these points. In particular, the bottom sections of the riders mounted on the tubular supports contribute towards generating cold charge areas in the charge.

2.) Prior Art

A carrying device of the aforementioned type is known from the U.S. Pat. Ser. No. 4,689,009 in which legs are attached to the sides of the top and bottom sections, partially encompassing the tubular support at a distance. Insulating material is packed in the cavities between the legs and the tubular support. However, the life of this insulating material is relatively short as the rider unavoidably moves against the tubular support due to thermal and mechanical stresses. Therefore, the shielding effect of the known design is only short-lived.

THE INVENTION

The object of the invention was therefore to create a lasting and extremely effective shielding of the charge from cold charge areas with simply and low-cost means.

The object is achieved by the carrying device in accordance with the invention which has the following characteristics:

The bottom section of the rider has sides which are inclined towards each other such that the bottom section, seen in cross-section, forms a trapeze which tapers in the direction of the top section of the rider;

the top section of the rider protrudes over each side of the bottom section forming a step;

at least one supporting cam is arranged on each side of the bottom section, said supporting cam exhibiting a top surface which slants downwards in the direction of the relevant side; and the heat insulation means is designed as plate-shaped elements which cover the sides of the bottom section of the rider and are provided with recesses for complementary engagement of the supporting cams.

The entire bottom section of the rider is therefore covered and thermally shielded by the plate-shaped elements of the heat insulation means. The plate-shaped elements reach a temperature which is higher than the temperature of the charge. Therefore, no heat flows from the charge to the bottom section of the rider. On the contrary, the heat flow is the opposite direction and contributes to the uniform warming of the charge.

The plate-shaped elements of the heat insulation means are held very securely as, under the effect of gravity, they rest on the inclined sides of the bottom section of the rider and in addition are supported on the top surfaces of the supporting cams which slant inwards. Furthermore, as they are not located between the rider and the cooled tubular support, any movements of the rider do not have an effect on the life of the heat insulation means.

The top section of the rider also provides an additional shielding of the plate-shaped elements as the plate-shaped elements grip under the steps which the top section and the sides of the bottom section form. These steps define the limit of wear of the rider so that protection is afforded until the rider is worn out.

Another major advantage to be emphasized is that the plate-shaped elements of the heat insulation means shield the bottom section of the rider on both sides and over the entire surface against the heat from the furnace chamber and therefore prevent it from heating up too much. This is advantageous regarding the life-time of the rider.

The aforementioned advantages are achieved with simple and low-cost means. The rider is of simple design and the plate-shaped elements which form the insulating material are also of simple design and, as pre-fabricated parts, can easily be mounted on the rider and replaced.

In a further embodiment of the present invention it is proposed that the plate-shaped elements of the heat insulation means each have a top surface whose sides protrude over the relevant step formed by the top section of the rider. This increases the heat transfer to the charge by radiation from solid bodies and thus reduces the cold charge areas.

This effect can be intensified by a top section of the rider which has sides which are inclined towards each other such that the top section, seen in cross-section, forms a trapezoid which tapers in the direction of the supporting surface of the top section.

It is particularly advantageous if the sides of the top section of the rider are more sharply inclined towards each other than the sides of the bottom section.

A major embodiment of the invention consists in the plate-shaped elements having an inner and an outer layer, the inner layer being made of a fire-proof felt with a high heat insulation factor and the outer layer consisting of a ceramic material with high resistance to thermal shocks. This leads, on the one hand, to effective heat insulation of the bottom section of the rider and, on the other hand, to a high surface temperature of the plate-shaped elements, which intensifies heating of the underside of the charge. The ceramic material preferably has scale-resisting properties.

The number of supporting cams can be adapted to the prevailing conditions. Thus, two supporting cams can be placed on each side of the bottom section of the rider, a single plate-shaped element being then arranged on each side. It has proved advantageous to arrange three supporting cams and two plate-shaped elements of the heat insulation means on each side of the bottom section of the rider. The plate-shaped elements can be easily replaced when necessary, the use of two elements on each side making partial replacement possible if only one half of a side of the bottom section is affected by wear.

The invention further proposes an alternative embodiment wherein each rider has a single, preferably centrally arranged supporting cam on each side of a bottom section and wherein the plate-shaped elements of the heat insulation means each partially lap over two neighbouring riders. This integrates the space between neighbouring riders into the heat insulation.

An embodiment of the present invention further consists in that the plate-shaped elements of the heat insulation means form a continuation of insulation which is partially surrounding the tubular support. The bottom section of the rider is therefore included in the insulation which is provided for the tubular support anyway so that the entire carrying device has the same insulation with the exception of the top sections of the riders up to the height of their limit of wear. However, the plate-shaped elements are not directly connected to the insulation of the tubular support in order to avoid increased wear of the heat insulation means through the movement of the riders.

It is also advantageous if the plate-shaped elements of the heat insulation material protrude sideways over the supporting cams in order to prevent the fronts of the supporting cams acting as heat sinks on the charge.

In a further embodiment it is proposed that the supporting cams each have an underside which is adjacent to an undersurface of the bottom section of the rider. The supporting cams and thus also the relevant recesses of the plate-shaped elements are therefore arranged at the greatest distance possible from the charge so that the unavoidable break in the surface of the plate-shaped elements has the least detrimental effect possible.

The supporting cams may be welded to the sides of the bottom section of the rider. However, it is more advantageous to design the rider and the supporting cams as a single casting of high-temperature-resistant material.

The present invention further relates to a high-temperature-resistant rider for a carrying device for supporting a charge, in particular of slabs, billets, ingots and the like in a reheating furnace, wherein the rider has a top section, which forms at least one supporting surface to support the charge, and a bottom section which can be mounted on a tubular support through which coolant flows. This object is achieved by a rider which is characterised in that

- the bottom section has sides which are inclined towards each other, the bottom section, seen in cross-section, forms a trapezoid which tapers in the direction of the top section of the rider,
- the top section of the rider protrudes forming a step over the sides of the bottom section;
- at least one supporting cam is arranged on each side of the bottom section, said supporting cam exhibiting a top surface which slants downwards in the direction of the relevant side.

The design of the rider according to the present invention is selected such that plate-shaped heat insulation elements can be mounted on the sides of the bottom section. These elements lie against the sides, resting on the top surfaces of the supporting cams. The bottom section of the rider can therefore be insulated from both sides, the long-term effect being that both the formation of cold charge areas and wear-increasing overheating of the bottom section of the rider are avoided.

Advantageous embodiments of the rider are described in claims 13 through 18.

DETAILED DESCRIPTION OF THE INVENTION

The invention is explained in the following using preferred embodiments and the attached drawings.

Figure 1:
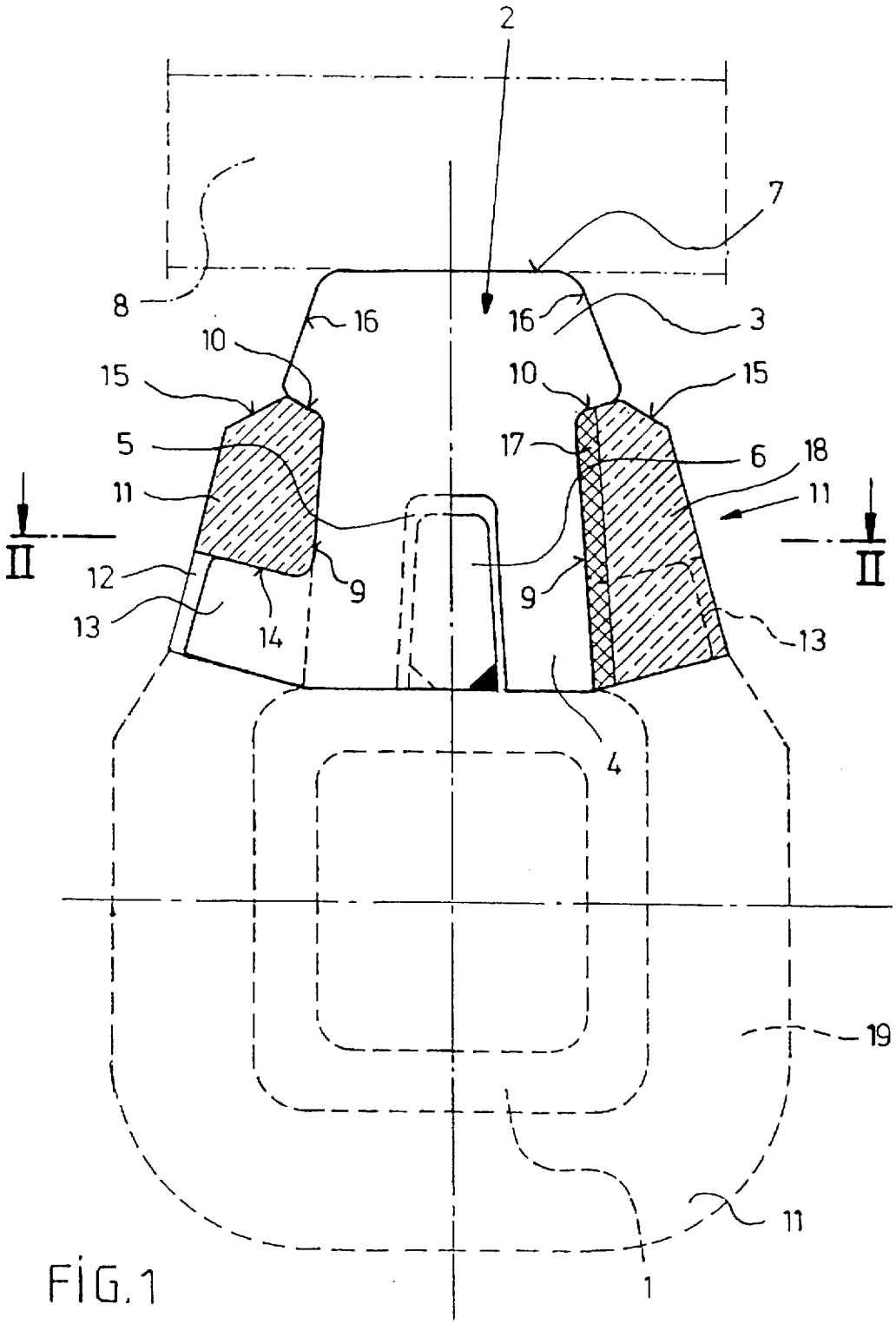
FIG. 1 shows a section through the vertical axis of a carrying device according to the present invention along the line I—I in FIG. 2.
Figure 2:
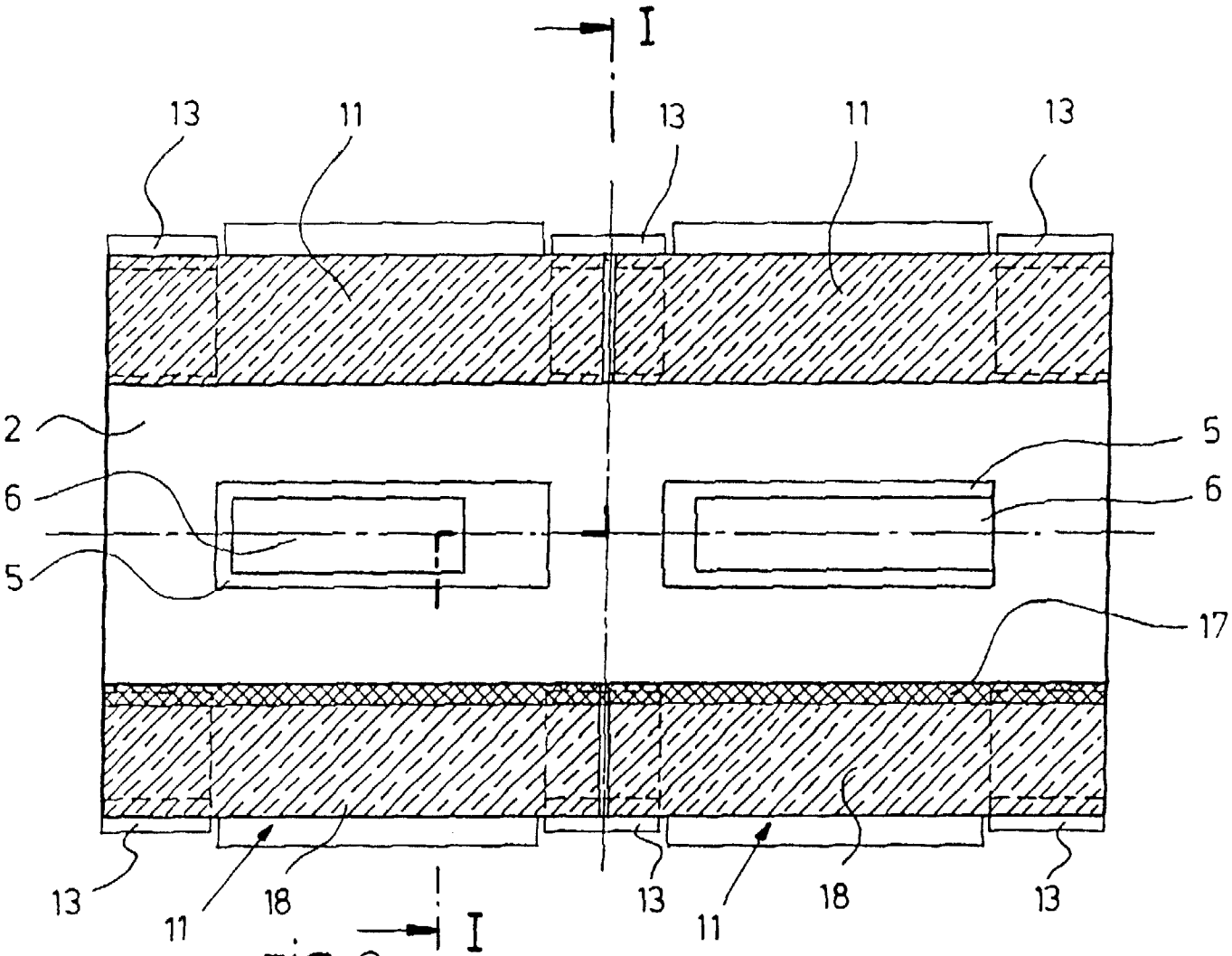
FIG. 2 shows a horizontal section along the line II—II in FIG. 1.
Figure 3:
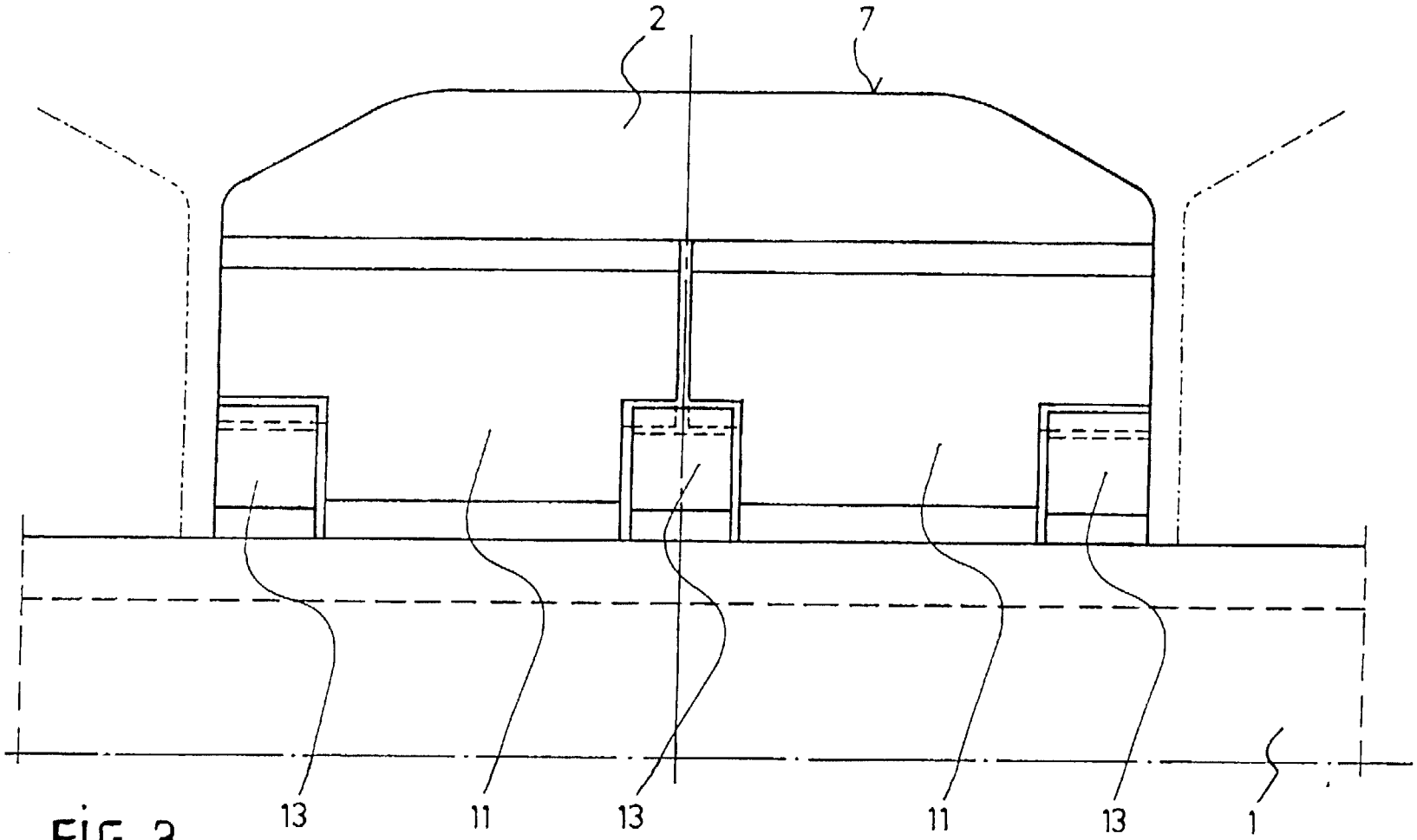
FIG. 3 shows a side view of the carrying device.

As depicted in FIGS. 1 through 3, a tubular support 1 is provided through which coolant flows and which carries a high-temperature-resistant rider 2, said rider having a top section 3 and a bottom section 4. The bottom section 4 of the rider 2 is mounted on the tubular support 1. The bottom section 4 has two recesses 5 into which relevant mounts 6 engage, said mounts being welded onto the tubular support 1. The top section 3 of the rider 2 forms a surface 7 to carry the charge 8.

As can be seen from FIG. 1, the bottom section 4 of the rider 2 is limited by sides which are inclined towards each other in such a manner that the cross-section of the bottom section 4 forms a trapezoid which tapers in the direction of the top section 3 of the rider 2. Furthermore, FIG. 1 shows that the top section 3 protrudes over the sides 9 of the bottom section 4 forming steps 10.

Plate-shaped heat insulation elements 11 covering the sides 9 of the bottom section 4 of the rider 2 are inserted into this configuration. Said heat insulation elements protect the bottom section 4 of the rider against overheating and reduce the formation of cold charge areas as their surface has a temperature which is higher than the temperature of the charge 8. Recesses 12 are provided in the plate-shaped elements and into which supporting cams 13 engage. Said supporting cams are located on the bottom ends of the sides 9 of the bottom section 4 and form a single casting with the rider 2. The top surfaces 14 of the supporting cams 13 are inclined in the direction of the relevant sides 9. In this manner the plate-shaped elements 11 are held securely, lying, under the effect of gravity, on the relevant inclined side 9.

The plate-shaped elements 11 each form a top surface 15 which protrudes over the relevant step 10 of the top section 3 of the rider 2. The heat dissipation in the direction of the charge 8 is thus enhanced. This effect is intensified by the fact that the top section 3 of the rider 2 is limited by sides 16 which are inclined towards each other so that the top section 3 also forms a trapezoid in cross-section which tapers in the direction of the supporting surface 7 more strongly than the bottom section 4.

Furthermore, the plate-shaped elements 11 also shield the supporting cams 13 by protruding over the latter.

In the left half of FIG. 1, the plate-shaped element 11 is designed as one element. In the right half, it consists of an inner layer 17 and an outer layer 18. The inner layer 17 is made of a fire-proof felt with a high heat insulation factor and the outer layer 18 of a ceramic material with high resistance to thermal shocks and scale-resisting properties.

As can also be seen from FIG. 1, the tubular support 1 is partially surrounded by insulation 19 which the plate-shaped heat insulation elements 11 of the rider 2 are adjacent to. The bottom section 4 of the rider 2 is therefore integrated into the heat insulation of the tubular support 1. However, the plate-shaped elements 11 and the insulation 19 are not firmly connected so that movements of the rider 2 on the tubular support 1 are possible without the heat insulation being affected in any way.

As can be seen from FIGS. 2 and 3, each rider 2 has three supporting cams 13 on each side 9 of its bottom section 4, said supporting cams 13 serving as mounts for two plate-shaped elements.

Figure 4:
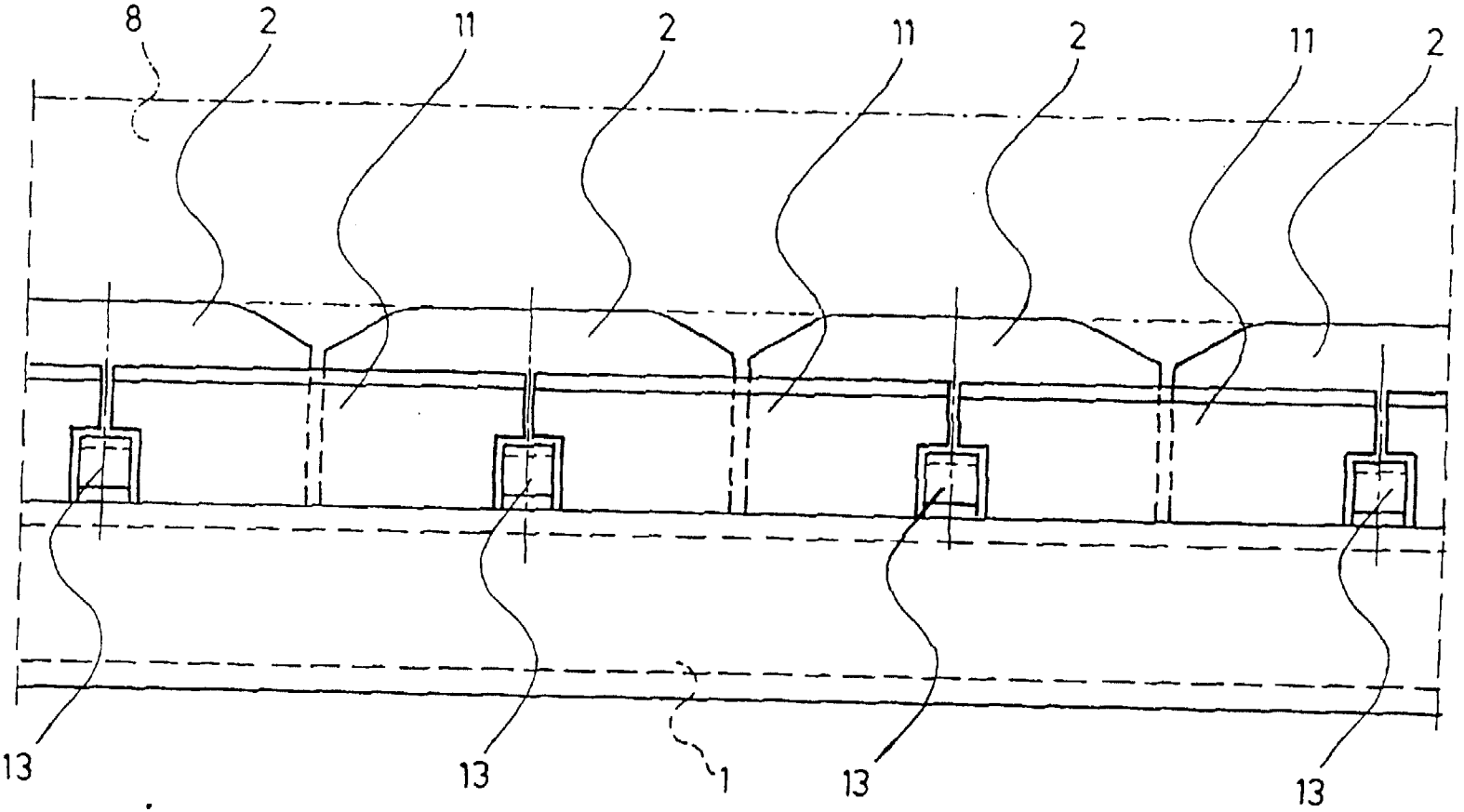
FIG. 4 shows from a view corresponding to FIG. 3 a side view of a modified embodiment

In the modified embodiment according to FIG. 4 by contrast, each side of each rider 2 is provided with a single supporting cam 13, the plate-shaped elements 11 each overlapping two neighbouring riders 2 by half and also shielding the space between the riders.

Figure 5:
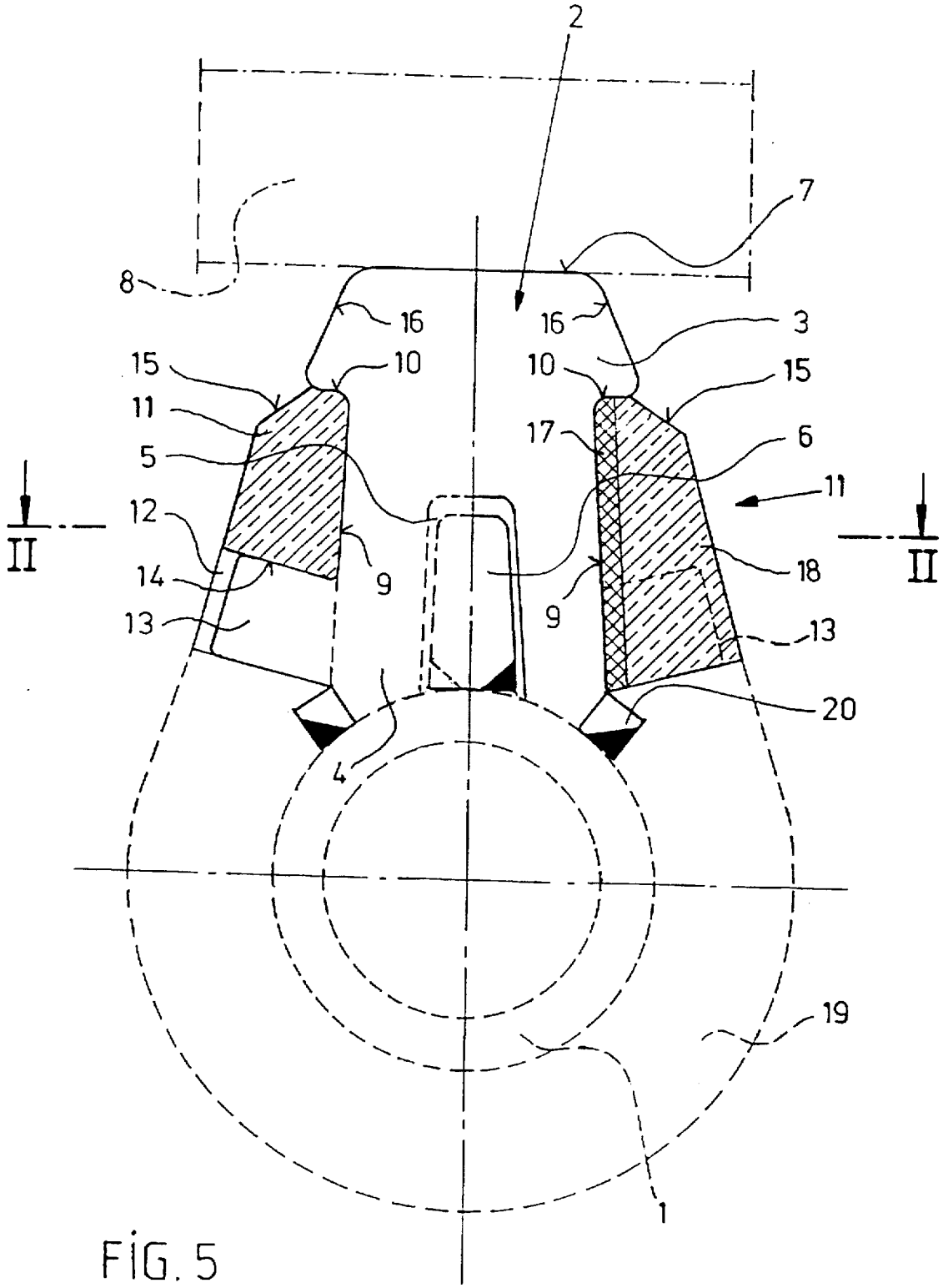
FIG. 5 shows from a view corresponding to FIG. 1 a section through a further modified embodiment.

The only-difference between the embodiment according to FIG. 5 and the embodiment according, to FIGS. 1 through 3 is that the tubular support 1 is not rectangular but circular in cross-section. Thus additional mounts 20 are welded onto the tubular support 1.

Modifications are perfectly possible within the scope of the present invention. For example, each rider can carry on each side of its bottom section a single, continuous plate-shaped heat insulation element, whereby two supporting cams may be sufficient. Furthermore, it is possible to weld the supporting cams onto the riders. The supporting cams may also be moved nearer to the steps 10 of the top section 3 which also define the limit of wear, even though the arrangement of the supporting cams on the bottom end of the bottom section is better from the heat engineering point of view.

I claim:

1. A carrying device for supporting a charge, in particular slabs, billets, ingots and the like in a reheating furnace, the carrying device having:

at least one tubular support through which coolant flows, at least one high-temperature-resistant rider which has a top section and a bottom section, the bottom section of the rider being mounted on the tubular support and the top section forming at least one support surface to support the charge, and heat insulation means arranged on the bottom section of the rider, wherein the bottom section of the rider has sides which are inclined towards each other such that the bottom section, seen in cross-section, forms a trapezoid which tapers in the direction of the top section of the rider;

wherein the top section of the rider protrudes forming a step over the sides of the bottom section;

wherein on each side of the bottom section at least one supporting cam is arranged which exhibits an upper surface slanting downwards in the direction of the relevant side, and wherein the heat insulation means is designed as plate-shaped elements which cover the sides of the bottom section of the rider and have recesses for complementary engagement of the supporting cams.

2. The carrying device as claimed in claim 1, wherein the plate-shaped elements of the heat insulation means each have an upper surface whose sides protrude over the relevant step formed by the top section of the rider.

3. The carrying device as claimed in claim 1, wherein the top section of the rider has sides which are inclined towards each other such that the top section, seen in cross-section, forms a trapezoid which tapers in the direction of the supporting surface of the top section.

4. The carrying device as claimed in claim 2, wherein the top section of the rider has sides which are inclined towards each other such that the top section, seen in cross-section, forms a trapezoid which tapers in the direction of the supporting surface of the top section.

5. The carrying device as claimed in claim 3, wherein the sides of the top section of the rider are inclined more sharply towards each other than the sides of the bottom section.

6. The carrying device as claimed in claim 4, wherein the sides of the top section of the rider are inclined more sharply towards each other than the sides of the bottom section.

7. The carrying device as claimed in claim 1, wherein the plate-shaped elements have an inner layer and an outer layer wherein the inner layer is made of a fire-proof felt with a high heat insulation factor and the outer layer consists of a ceramic material with high resistance to thermal shocks.

8. The carrying device as claimed in claim 1, wherein three supporting cams and two plate-shaped elements of the heat insulation means are arranged on each side of the bottom section of the rider.

9. The carrying device as claimed in claim 1, wherein the plate-shaped elements of the heat insulation means each partially overlap two neighbouring riders and wherein each of the neighbouring riders has one single supporting cam on each side of its bottom section.

10. The carrying device as claimed in claim 9, wherein the single supporting cam is arranged centrally on the relevant side of the bottom section of the relevant rider.

11. The carrying device as claimed in claim 1, wherein the plate-shaped elements of the heat insulation means form a continuation of insulation which partially surrounds the tubular support.

12. The carrying device as claimed in claim 1, wherein the plate-shaped elements of the heat insulation means protrude sideways over the supporting cams.

13. The carrying device as claimed in claim 1, wherein the supporting cams each have an undersurface which is adjacent to the undersurface of the bottom section of the rider.

14. The carrying device as claimed in claim 1, wherein the rider and the supporting cam are cast in one piece.

15. A high-temperature-resistant rider for a carrying device for supporting a charge, in particular of slabs, billets, ingots and the like in a reheating furnace, the rider having a top section, which forms at least one supporting surface to support the charge, and a bottom section which can be mounted on the tubular support through which coolant flows, wherein the bottom section of the rider has sides which are inclined towards each other such that the bottom section, seen in cross-section, forms a trapezoid which tapers in the direction of the top section of the rider, wherein the top section of the rider protrudes over the sides of the bottom section forming a step, wherein at least one supporting cam is arranged on each side of the bottom section, said supporting cam having an upper surface slanting downwards in the direction of the relevant side.

16. The rider as claimed in claim 15, wherein the top section of the rider has sides which are inclined towards each other such that the top section, seen in cross-section, forms a trapeze, which tapers in the direction of the supporting surface of the top section.

17. The rider as claimed in claim 16, wherein the sides of the top section of the rider are inclined more sharply towards each other than the sides of the bottom section.

18. The rider as claimed in claim 15, wherein three supporting cams are arranged on each side of the bottom section of the rider.

19. The rider as claimed in claim 15, wherein a single, preferably centrally arranged supporting cam is provided on each side of the bottom section.

20. The rider as claimed in claim 19, wherein the single supporting cam is arranged centrally on the relevant side of the bottom section.

21. The rider as claimed in claim 15, wherein the supporting cams each have an undersurface which is adjacent to an undersurface of the bottom section of the rider.

22. The rider as claimed in claim 15, wherein the rider and the supporting cam are cast in one piece.

* * * * *

UNITED STATES PATENT AND TRADEMARK OFFICE

CERTIFICATE OF CORRECTION

PATENT NO. : 5,895,216

DATED : April 20, 1999

INVENTOR(S) : Heuss

It is certified that errors appear in the above-identified patent and that said Letters Patent is hereby corrected as shown below:

In column 1, line 12, delete "a bottom sections" and insert -- a bottom section, -- .

In column 5, line 15, delete "embodiment according, to FIGS. 1" and insert -- embodiment according to FIGS. 1 -- .

In column 6, line 59, delete "a trapeze" and insert -- a trapezoid -- .

Signed and Sealed this

Thirtieth Day of January, 2001

*Attest:*

Q. TODD DICKINSON

*Attesting Officer*

*Director of Patents and Trademarks*